US006394321B1

(12) United States Patent
Bayer

(10) Patent No.: US 6,394,321 B1
(45) Date of Patent: May 28, 2002

(54) AEROSOL POWDER VALVE

(75) Inventor: Christian Bayer, Armonk, NY (US)

(73) Assignee: Precision Valve Corporation, Yonkers, NY (US)

( * ) Notice: Subject to any disclaimer, the term of this patent is extended or adjusted under 35 U.S.C. 154(b) by 0 days.

(21) Appl. No.: 10/027,596

(22) Filed: Dec. 20, 2001

(51) Int. Cl.[7] ..... B65D 83/16
(52) U.S. Cl. ..... 222/402.24
(58) Field of Search ..... 222/402.1, 402.24

(56) References Cited

U.S. PATENT DOCUMENTS

| | | | | | |
|---|---|---|---|---|---|
| 3,160,182 | A | * | 12/1964 | O'Donnel | 222/402.24 |
| 3,174,692 | A | * | 3/1965 | Green | 222/402.24 |
| 3,187,963 | A | * | 6/1965 | Anderson | 222/402.24 |
| 3,773,064 | A | * | 11/1973 | Focht | 222/402.24 |
| 5,975,378 | A | * | 11/1999 | Bayer | 222/402.24 |
| 6,039,306 | A | * | 3/2000 | Pericard et al. | 222/402.24 |

* cited by examiner

*Primary Examiner*—Kenneth Bomberg
(74) *Attorney, Agent, or Firm*—Kilgannon & Steidl

(57) ABSTRACT

An aerosol powder valve having a valve housing, a valve body, a valve stem, a gasket-retaining groove about the valve stem, and at least one valve orifice through the stem wall communicating with the groove and the stem discharge passage. The valve body below the groove has a plurality of vertical splines about its periphery with minimal area top surfaces of the splines abutting the gasket in the closed valve position. Circumferential spaces extend between the splines. The valve groove has a top annular surface, an intermediate neck portion with the one or more valve orifices, and a lower annular surface extending downwardly and outwardly at a sharp angle to the horizontal from the neck portion to the outer circumference of the valve body to join the valve body outer circumference at the level of the tops of the splines. The sharply angled annular lower groove surface may be frustoconical or preferably slightly convex, and has no horizontal or concave components for powder accumulation. The gasket seals the groove lower surface in the closed valve position and wipes the groove lower surface outwardly when the valve moves from open to closed position to cause any powder on the groove lower surface to fall into the circumferential spaces between the splines. The diameter of the valve body between the splines, at the level of the tops of the splines, is the same as the diameter of the valve stem above the groove. No powder build up can occur to interfere with the gasket sealing of the valve.

5 Claims, 6 Drawing Sheets

AEROSOL POWDER VALVE

FIELD OF THE INVENTION

The present invention relates to valves to dispense products from pressurized containers, and more particularly to aerosol valves for dispensing powders held in suspension in liquified propellants in such containers.

BACKGROUND OF THE INVENTION

In a conventional form of aerosol valve assembly, a vertically acting aerosol valve is opened to release product in the aerosol container by downwardly depressing a button or cap attached to the top of the upstanding stem of the aerosol valve. When the button is released, the valve is closed by a spring acting on the valve. The valve body positioned at the lower part of the valve stem has an upper horizontal continuous sealing surface circumferentially surrounding the valve stem. This upper horizontal surface, when the aerosol valve is closed, is urged upwardly into sealing relation against the valve sealing gasket by the spring acting on the valve body. One or more orifices in the valve stem are positioned above the lower surface of the valve gasket when the valve is in the closed position. The valve stem passes through a central opening in the gasket, and the circumferential surface of the central opening may provide a radially acting, secondary seal of the valve stem when the valve is closed. When the valve is opened by pressing the button, the valve stem moves downwardly and its one or more orifices will move to a position below the gasket. Product in the aerosol container may now, under the influence of propellant, pass upwardly through the conventional dip tube into the valve housing which surrounds the valve stem and valve body, then upwardly to flow over the upper horizontal surface of the valve body circumferentially surrounding the valve stem, through the one or more orifices into the valve stem, upwardly through the valve stem, and outwardly through an outlet nozzle in the button or cap attached to the top of the valve stem.

The above-described conventional aerosol valve is used to dispense many products including, in aspects particularly relevant to the present invention, products having powder suspended in a liquified propellant. Such products include anti-perspirants, deodorants, foot sprays, etc. Unfortunately, the action of the conventional aerosol valve is compromised by powder build-up on the aforedescribed upper horizontal sealing surface of the valve body when the powder product is released from the aerosol container. This powder accumulation interferes with the full resealing action of the valve by causing the valve to be held partially open after the button is released. The result is that the aerosol container loses pressure even when not in use, and the propellant leakage can impair or destroy the usefulness of the pressurized container after a few operations of the valve. The problem is further exacerbated in the circumstance where modern day high powder loading is desired in the product to be dispensed, for example fifty-sixty percent solids by weight in the case of certain powder antiperspirants where the solids include the powder and other solids in the formulation.

Attempts have been made to overcome the above problems of powder valves, one such instance being disclosed in UK Patent Specification 12166550 wherein a plurality of concentric ribs with sharp top edges are placed on the aforesaid top horizontal sealing surface of the valve body (or on the lower gasket sealing surface) to encircle the valve stem. The sharp top edges cooperate with the gasket to form the valve sealing surfaces, and when powder product is released by actuating the valve, powder build-up is intended to occur inside of, outside of and in the valleys between the concentric ribs rather than at the tops of the ribs. However, powder can still accumulate sufficiently in the valleys to ultimately interfere with the valve sealing action.

A further attempt to overcome the above problems of powder valves is disclosed in U.S. Pat. No. 3,773,064, wherein a circumferential groove surrounds the valve stem with the orifices lying in a conical outwardly tapering section at the top of the groove and the sealing gasket fitting within the groove and around the conical section. A protruding cylindrical ridge in the groove presses into the gasket to enhance sealing. However, the compound surfaces including the bottom of the groove still present opportunities for powder build-up in the design, particularly under present day requirements for powder products having heavy loading of solids.

A still further attempt to overcome the above problems of powder valves is disclosed in U.S. Pat. No. 4,013,197, wherein the valve orifice is in the straight portion of the stem, a groove is positioned below the valve orifice, and a gasket sits partially in and partially out of the groove when the valve is closed to create a primary seal on the straight portion of the stem below the valve orifice and a secondary seal in the groove. The gasket is said to wipe powder from the sealing surfaces on closing of the valve. The design requires excessive stem displacement when depressing the stem to move the valve orifice from above to below the gasket, and excessive gasket deflection since the gasket enters and leaves the groove on opening and closing the valve. Excessive material is also used in the valve body since it requires a wide circumference to accommodate the particular form of groove and gasket. Further, a horizontal annular surface below (or above) the groove on the valve body will accumulate powder to interfere with the secondary seal below the groove.

A successful effort to overcome the above problems of powder valves is disclosed in my prior U.S. Pat. No. 5,975,378 of Nov. 2, 1999, incorporated herein by reference, wherein the conventional upper horizontal sealing surface of the valve body about the valve stem is eliminated. The sealing of the valve is obtained solely in radial directions toward the valve stem by a tight-fitting gasket encircling the valve stem. The outer surface of the valve stem is a straight up and down cylindrical surface having for example two lateral entry orifices, the straight stem surface not including the conventional prior art gasket groove. In the design of this patent, there are no horizontal sealing surfaces and none of the usual groove surfaces where powder can otherwise accumulate to affect the valve sealing function or clog the orifices. The lower valve body is a continuation of the straight valve stem with the exception of a plurality of narrow vertically extending splines spaced about the circumference of the valve body and having large circumferential spaces between each adjacent pair of splines. Each of the plurality of splines tapers inwardly in circumferential direction as the spline nears its upward limit, and the top of each spline forms a minimal horizontal area. When the powder valve is closed, the top of each spline abuts against the sealing gasket to limit the upward return travel of the valve stem under the influence of the valve spring. The minimal horizontal top area of each spline results in a minimum individual and total horizontal surface at the top of the splines, thus preventing powder building up on the tops of the splines to adversely affect the sealing of the valve. The large circumferential spacing between the splines allows powder to fall down between the splines and away from the gasket when the valve is closed, thus preventing any powder build-up on the gasket and stem orifices to interfere with sealing or clogging of the stem orifices.

SUMMARY OF THE INVENTION

The present invention also is intended to provide an aerosol powder valve that eliminates the problem of powder build-up interfering with the valve sealing action. The present invention incorporates certain aspects of my prior U.S. Pat. No. 5,975,378, in combination with an alternative stem design having a gasket-retaining stem groove of a particular profile. The present invention is particularly advantageous for dispensing powder products having higher percentages of solid particles.

More specifically, the present invention utilizes the afore-described spline configuration of my prior U.S. Pat. No. 5,975,378 but incorporates thereabove a stem groove extending into and encircling the outer wall of the stem. One or more valve orifices extend through the stem wall into communication with both the stem discharge passage and the stem groove. The valve sealing gasket with its central opening encircles the valve stem and extends into the stem groove. The stem groove is defined, from top to bottom, by an upper annular surface extending downwardly and inwardly from the stem outer surface, a downwardly extending intermediate neck portion, and a lower annular surface extending downwardly and outwardly from the neck portion out to the valve body circumference. The lower downwardly and outwardly extending groove surface extends at a steep angle to the horizontal, and is either a frustoconical surface or preferably a slightly convex surface with a small radius for reasons hereafter discussed. The downwardly extending angle to the horizontal may for example be of the order of fifty degrees, and the convex surface may for example have a radius of curvature of 0.091 inches. These are merely examples, but what is important is that the groove does not have a lower gasket engaging surface that contains or approximates horizontal or concave surfaces so as to accumulate powder during valve operation, leading to leakage between the lower and intermediate groove surfaces and the gasket, and/or to clogging of the valve orifices from the stem groove into the stem discharge passage. Further and importantly, the profile of the lower portion of the stem groove provides a means to remove any powder that may stick to the sharply downwardly and outwardly extending surface. When the powder valve of the present invention is closed the gasket extending into the groove seals against the lower portion of the stem groove. When the powder valve is actuated, the valve stem is depressed and the lower portion of the stem groove accordingly drops below and is spaced from the gasket. The gasket is partially bent away from the stem groove and accordingly no longer seals the valve orifices extending from the groove into the stem discharge passage. As the actuation force is removed from the valve stem, the stem begins to rise under the force of the valve spring. As this occurs, the lower and inner portions of the gasket wipe across the intermediate groove surface and the sharply downwardly and outwardly extending lower groove surface, in a direction to sweep any powder sticking on said surfaces outwardly to the valve body circumference where such powder will fall down between the splines.

Accordingly, the aerosol powder valve of the present invention eliminates any deleterious powder build up, due to both the steep and preferably radiused lower groove surface and the wiping action of the gasket thereacross as the valve is closed from an open position. This holds true through all the successive cycles of operation of the powder valve, thereby resulting in insignificant leakage and optimum usage of propellant and product in the aerosol container.

Other features and advantages of the present invention will be apparent from the following description, drawings and claims.

DETAILED DESCRIPTION OF EMBODIMENT

Figure 1:
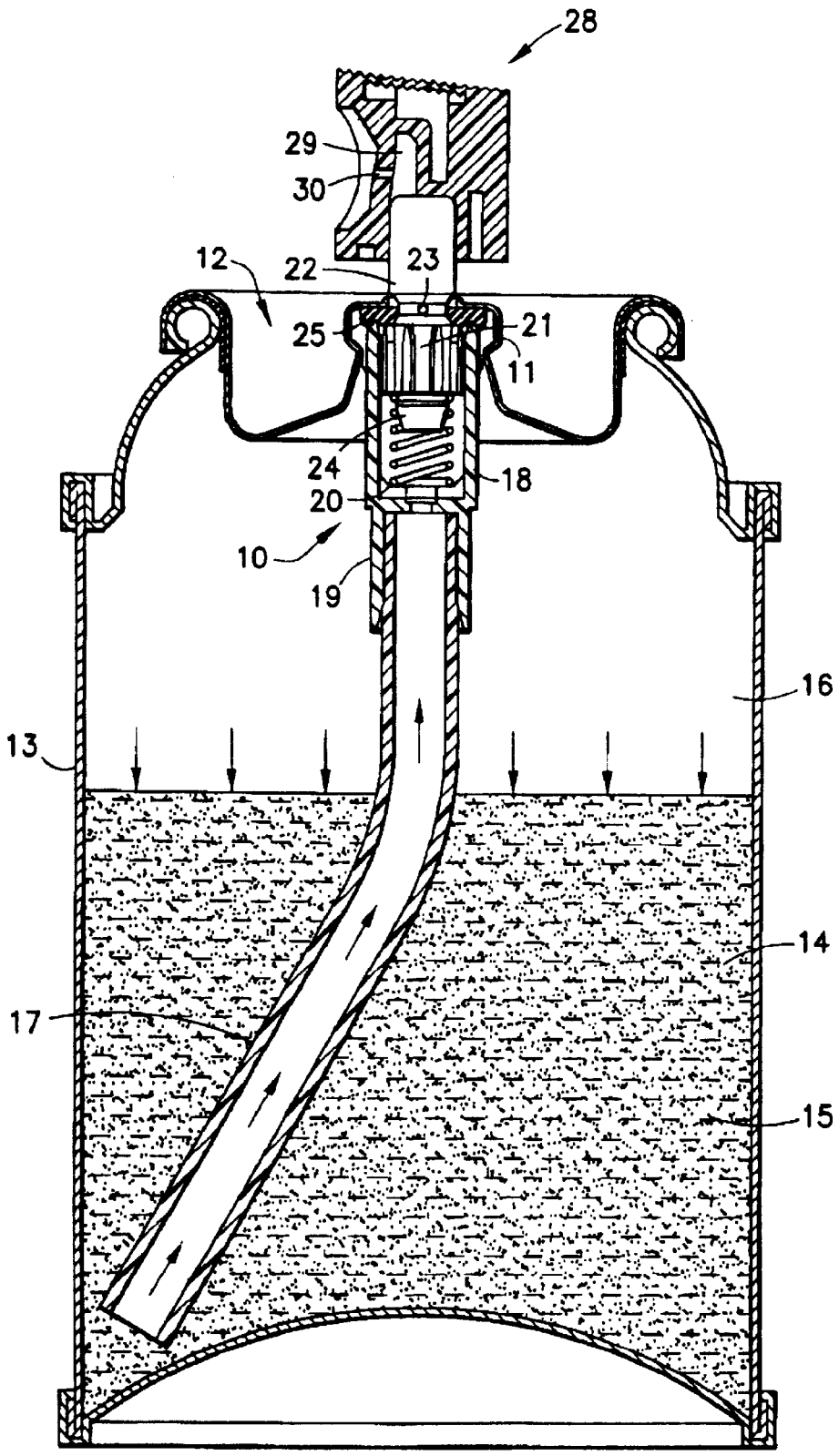
FIG. 1 is a side elevational view in partial section of an assembled powder valve of the present invention mounted within an aerosol container.

Referring to FIGS. 1–4, an aerosol valve assembly, designated generally as 10, is fitted and crimped into a pedestal portion 11 of a mounting cup closure 12 for a pressurized container 13. Container 13 holds a liquified propellant 14 having a powder product 15 in suspension throughout, the gaseous propellant phase 16 overlying the liquified propellant.

Valve assembly 10 generally includes a dip tube 17, a valve housing 18, a dip tube receiving channel 19 at the bottom of valve housing 18, valve closing coil spring 20, and valve body 21. The valve body 21 has hollow valve stem 22 extending upwardly therefrom and containing two lateral orifices 23 entering from stem groove 55 into the interior of stem 22. Protrusion 24 extends downwardly from the valve body 21 and captures and centers the top of coil spring 20.

Figure 2:
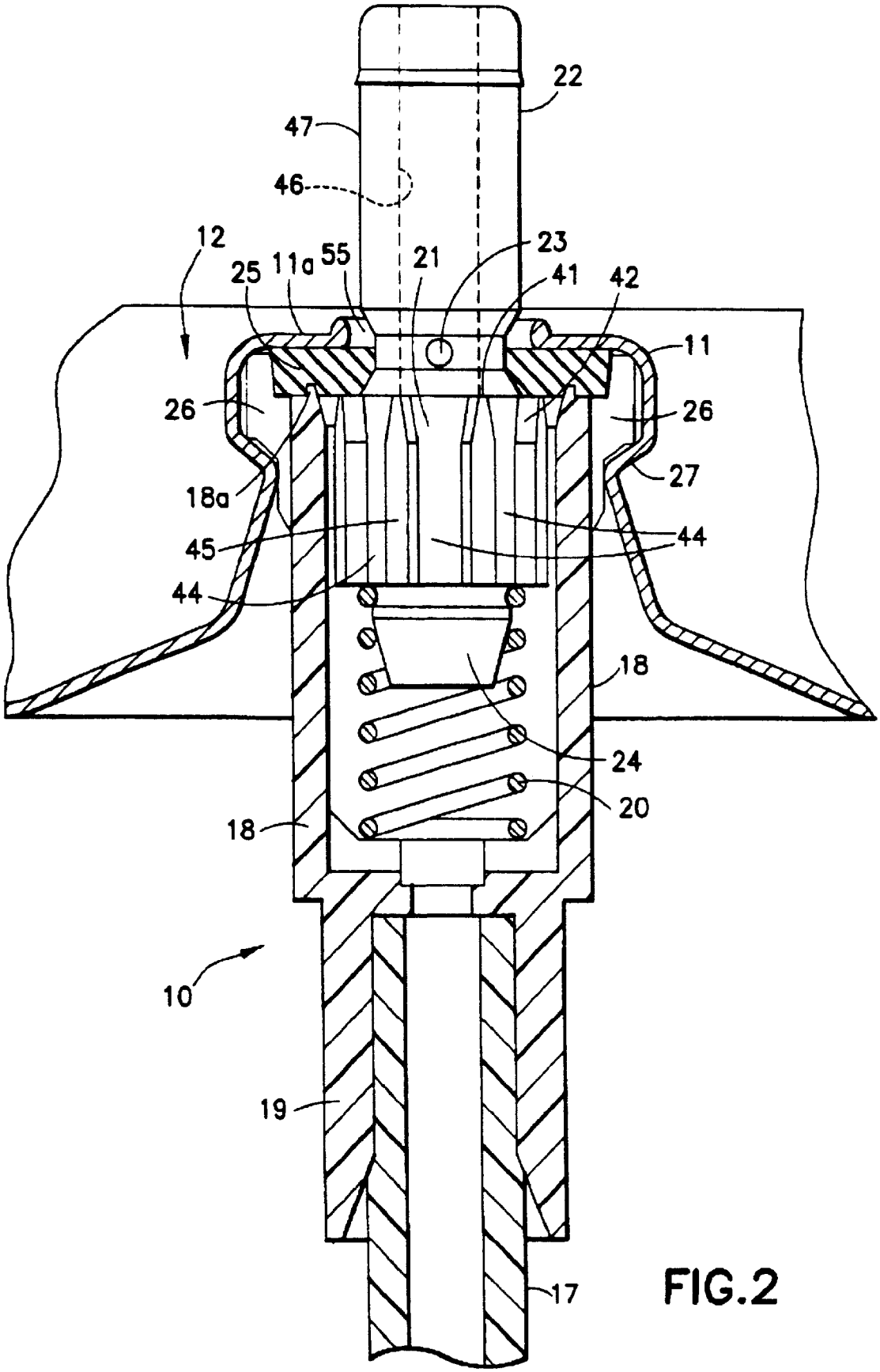
FIG. 2 is an enlarged side elevational view in partial section of an assembled powder valve of the present invention, the valve being in a closed position.

Resilient annular gasket 25 surrounds valve stem 22, extends into annular groove 55 in stem 22, and seals both the stem orifices 23 when the aerosol valve is closed (FIGS. 1 and 2). Annular gasket 25 is clamped between the underside 11*a* of pedestal portion 11 of the mounting cup 12 and the upper part 18*a* of valve housing 18. Valve housing 18 includes spacers 26 spaced about the periphery of the valve housing for pressurized filling of the container, all as more fully described in U.S. Pat. No. 4,015,757 (incorporated herein by reference) and forming no part of the present invention. The mounting cup is crimped at 27 around spacers 26 to retain the aerosol valve assembly 10.

Attached to the top of valve stem 22 by an annular channel is a conventional actuating button 28 having an internal product passage 29 in fluid contact with the hollow valve stem 22 and having outlet nozzle 30 for product ejection. When the button 28 is pressed downwardly against the force of spring 20, stem orifices 23 pass below annular gasket 25 (see FIG. 3) and the product within the aerosol container can now pass up dip tube 17, upwardly around valve body 21, into stem groove 55 and through the valve orifices 23 into the valve stem 22, upwardly through the hollow stem into the actuating button 28, and outwardly through nozzle 30. When the button 28 is released, the spring 20 urges the valve stem 22 upwardly to the FIG. 2 position where the stem orifices 23 are now blocked by gasket 25. The valve is now closed and product flow is blocked from entering into the valve stem.

The above discussion in its generality applies to conventional aerosol valves. However, in such valves it is common for the valve body below the stem orifices to be an essentially cylindrical member with greater diameter than the valve stem, thus having a continuous upper horizontal surface extending circumferentially around the valve stem and conventionally abutting the underside of the sealing gasket when the valve is closed to provide a continuous horizontal valve sealing surface around the stem. It is this horizontal surface and/or corresponding horizontal or concave lower surfaces of conventional prior art stem grooves that present the surfaces upon which powder builds up in successive valve operations to ultimately impair the valve sealing and create undesirable propellant leakage. However, the present invention eliminates said horizontal surfaces and combines the spline configuration of my prior U.S. Pat. No. 5,975,378 (but without the grooveless stem thereof) with a stem groove of a particular profile to eliminate the powder build up.

Now turning to the specific features of the present invention, the valve stem and valve body below the stem are more fully shown in FIGS. 5–10. The afore-described continuous horizontal sealing surface of the valve body is eliminated, and the valve body 21 below the valve stem 22 is a vertical continuation of the valve stem 22 above stem groove 55 with the exception of eight narrow splines 40 equally spaced about the periphery of the valve body. Each spline 40 has a top surface 41 of minimal horizontal area. Tapered spline sides 42 diverge in circumferential directions from top surface 41 for a certain downward distance and then spline sides 43 extend vertically downward. Accordingly each spline 40 has sufficient structural integrity over most of its vertical extent to prevent damage in handling during valve manufacture and assembly operations, but at the same time each spline tapers at its top to provide the desired top surfaces 41 of minimal area. Large circumferential spaces 44 remain between each adjacent pair of splines 40. Stem orifices 23 are circumferentially displaced from the tops of adjacent splines so as to lie between a pair of adjacent splines.

Referring to FIG. 2, it will be seen that only the minimal top areas 41 of each spline 40 abut sealing gasket 25 when the valve is closed, thus providing no gasket sealing function but only the function of limiting the upward return travel of valve stem 22 under the influence of the spring when the valve is closed. The number of splines and their individual top surface horizontal areas will be selected such that the splines (a) will not pierce the sealing gasket to destroy its sealing function, and (b) will have minimal top horizontal areas to prevent powder build-up on the tops of the splines. In the embodiment herein described, eight equally-spaced splines surround the valve body, each having a top surface area of approximately 0.000235 square inches directly abutting the vertical body surface.

Figure 5:
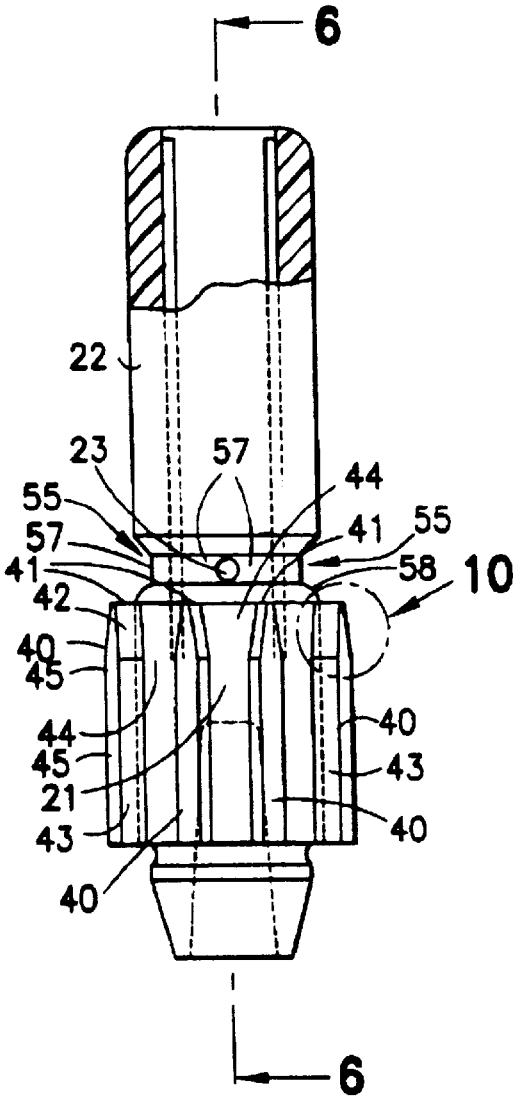
FIG. 5 is an enlarged side elevational view of the valve stem and valve body of the present invention.
Figure 7:
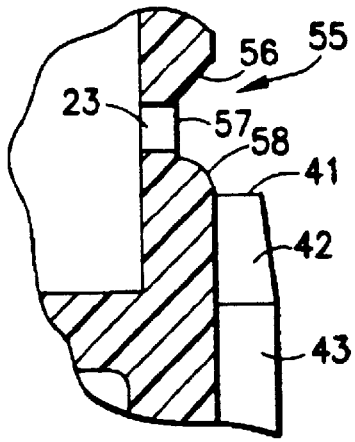
FIG. 7 is an enlarged fragmented view taken from FIG. 6 and illustrating the stem groove of the present invention, a slightly convex lower groove surface being shown in quite exaggerated fashion (as it is in FIGS. 5 and 6) for purposes of clarity.
Figure 6:
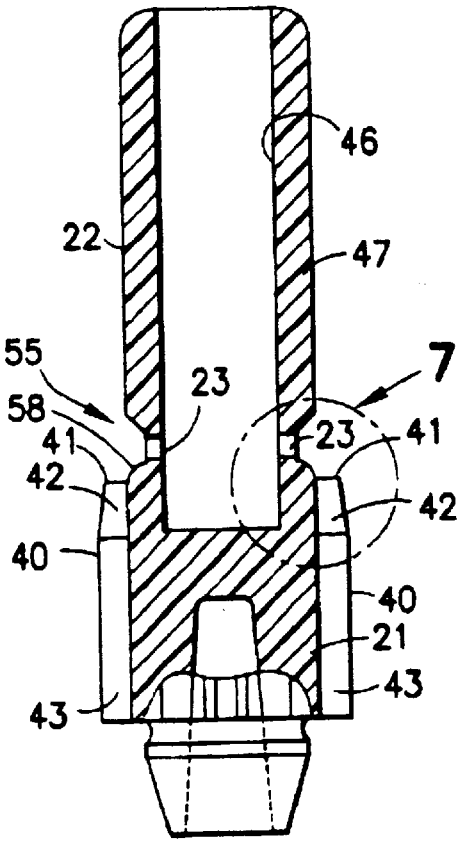
FIG. 6 is a partial cross-sectional view of the valve stem and valve body of the present invention taken along lines 6—6 of FIG. 5.
Figure 8:
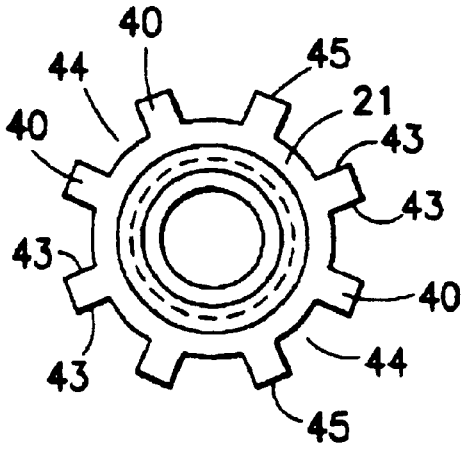
FIG. 8 is a bottom plan view of the valve stem and valve body of FIG. 5.
Figure 9:
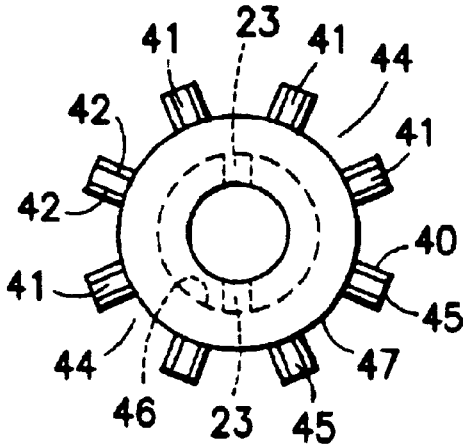
FIG. 9 is a top plan view of the valve stem and valve body of FIG. 5.
Figure 10:
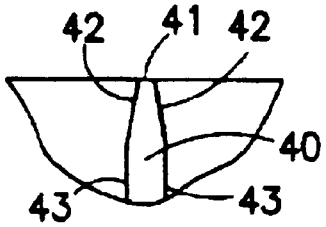
FIG. 10 is a fragmentary view taken from FIG. 5.

FIGS. 5–7 illustrate in particular the gasket-retaining stem groove 55 of the present invention. For purposes of definition herein, valve body 21 extends from the level of the tops 41 of splines 40 downwardly, and valve stem 22 extends from the level of the tops 41 of splines 40 upwardly. Groove 55 has an upper annular frustoconical surface 56 extending downwardly and inwardly from the stem outer circumference, a downwardly extending intermediate neck portion 57 which contains valve orifices 23, and lower annular surface 58 extending downwardly and outwardly from neck portion 57 to the outer circumference of valve body 21 about which the narrow splines 40 are positioned. Surface 58 joins the outer circumference of valve body 21 between the splines at the level of the tops of the splines 41. Lower groove surface 58 extends at a steep angle to the horizontal, approximately fifty degrees merely as an example, and is either frustoconical or may be slightly convex (shown in quite exaggerated fashion in FIGS. 5–7 to allow the convexity to be seen) with a small radius. Surface 58 should not contain or approximate horizontal or concave surfaces, since such surfaces will retain powder.

Figure 3:
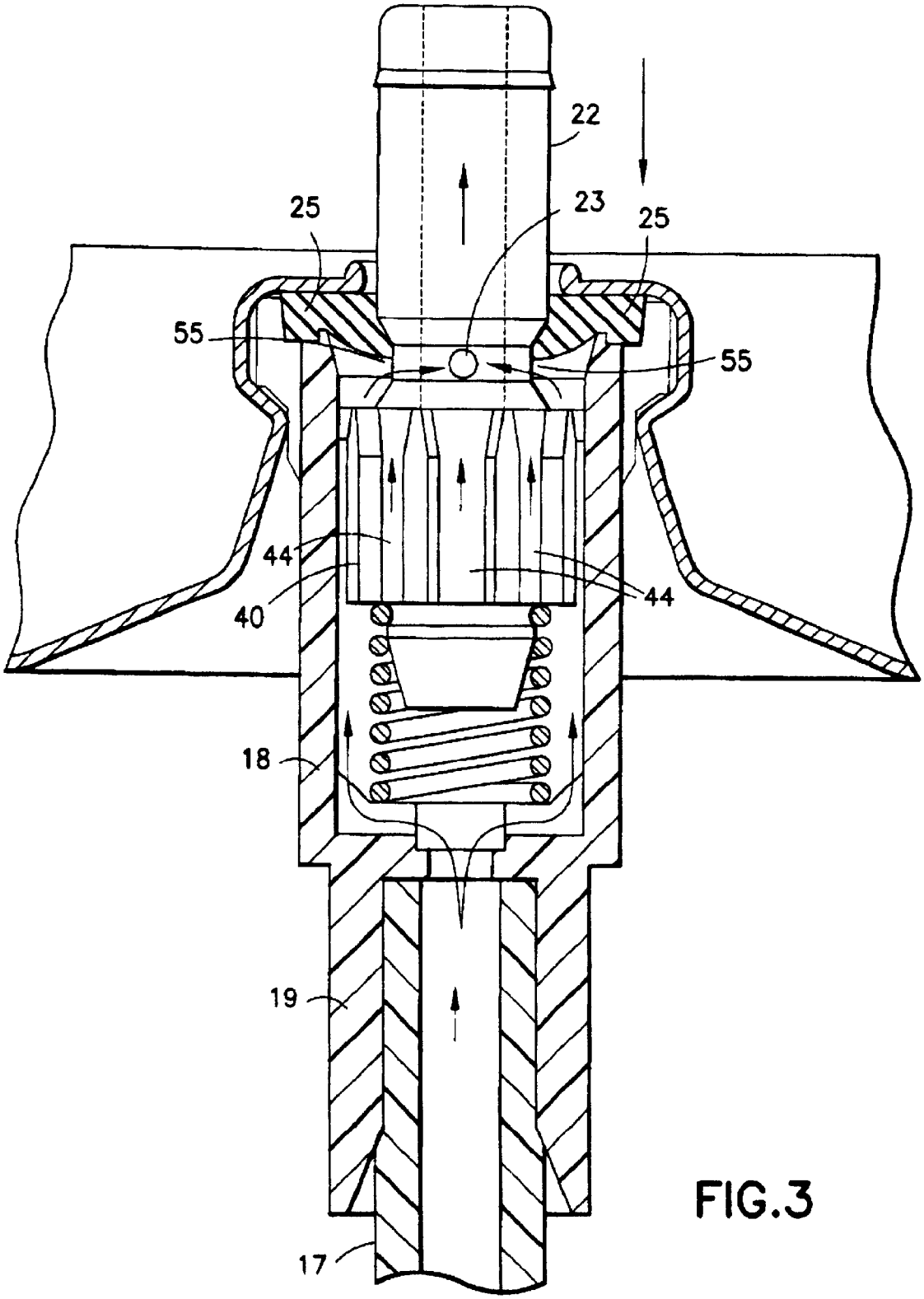
FIG. 3 is an enlarged side elevational view in partial section of an assembled powder valve of the present invention, the valve being in an open position.

When the aerosol valve of the present invention is closed, as shown in FIG. 2, gasket 55 contacts the tops 41 of splines 40, is retained in groove 55, seals against sharply downwardly angled lower groove surface 58, and seals valve orifices 23 in groove neck portion 57. When the aerosol valve is opened, as shown in FIG. 3, the sharply downwardly angled lower groove surface 58 drops below gasket 25. Powder product in the aerosol container, in suspension in the liquified propellant, now flows up dip tube 17 into valve housing 18, up along the outside circumference of valve body 21 in channels 44 between splines 40 and also between splines 40 and the inner surface of valve housing 18, into groove 55 along sharply angled lower groove surface 58, and through valve orifices 23 into the stem discharge passage.

During this product discharge, the sharply angled lower groove surface 58 of frustoconical or slightly convex profile will not have significant powder build up, in contrast to a lower groove surface having a horizontal and/or concave profile which may accumulate significant powder. Thus, when the gasket 25 returns in sealing relationship to lower groove surface 58 when the valve is closed, discharge will not occur under the gasket due to powder build up holding the gasket off from lower groove surface 58. As will be understood, the present invention has no significant horizontal surfaces available for powder build up in the vicinity of the valve sealing surfaces.

Figure 4:
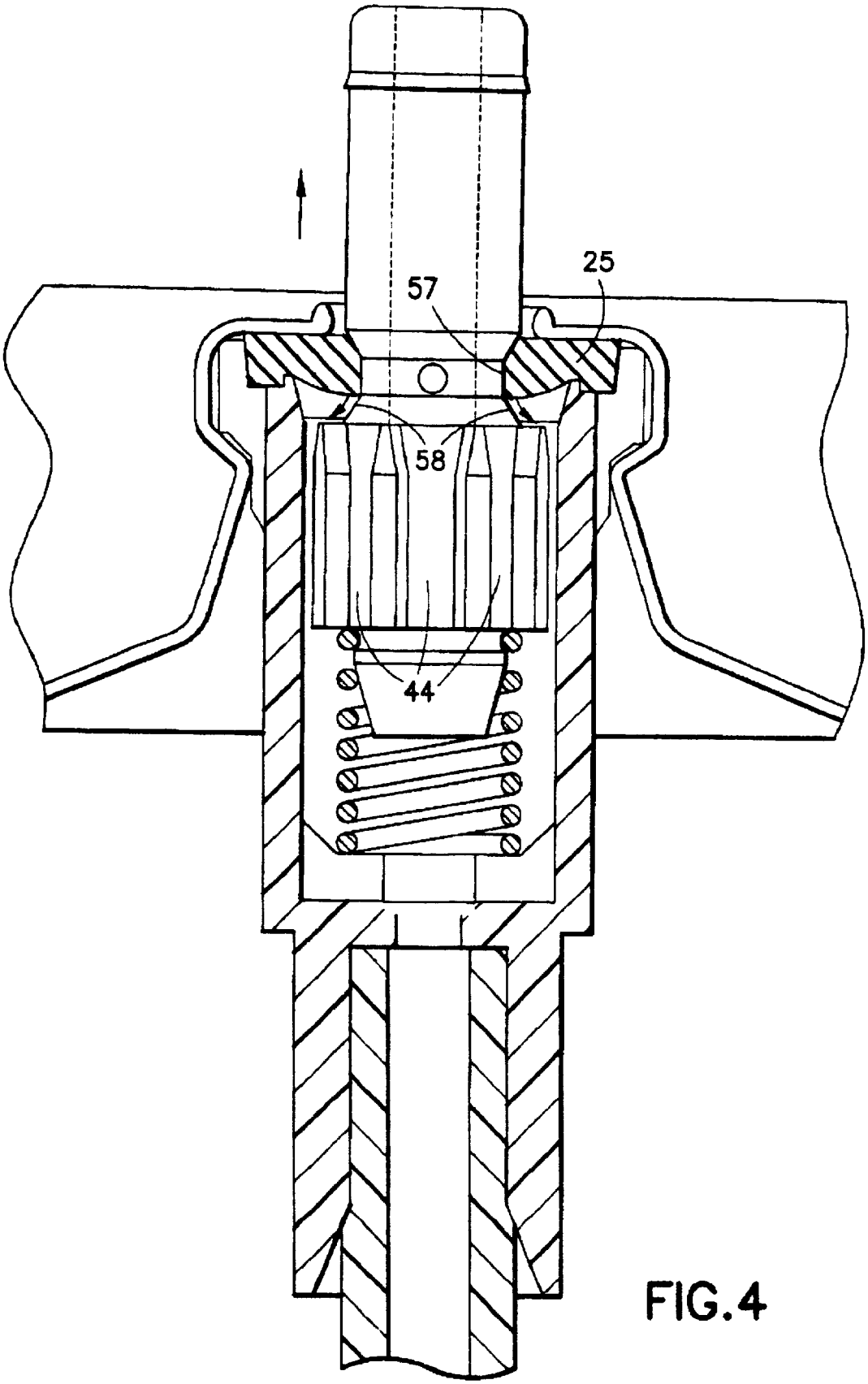
FIG. 4 is an enlarged side elevational view in partial section of an assembled powder valve of the present invention, the valve beginning to return from the open to the closed position.

Further, and importantly, the frustoconical or slightly convex lower groove surface 58 presents a profile to gasket 25 when the valve begins to close such that the inner and lower surfaces of gasket 25 will wipe any powder accumulating on surface 58 downwardly and outwardly to the outer circumference of valve body 21 where any such powder drops through the channels 44 between splines 40. This can be seen by comparing the gasket position of FIG. 4 where the valve is beginning to close with the gasket position of FIG. 2 where the valve has closed. In FIG. 4 as compared with FIG. 3, the inner and lower parts of the gasket have wiped across intermediate groove portion 57 to move any accumulated powder downwardly, and that powder and any accumulated powder on sharply angled lower groove surface 58 are wiped outwardly as shown by the arrows in FIG. 4 as the position of gasket 25 moves from that of FIG. 4 to the closed valve position of FIG. 2. The large circumferential spacing between the splines allows powder to fall back down between the splines and away from the gasket when the valve is closed.

Figure 11:
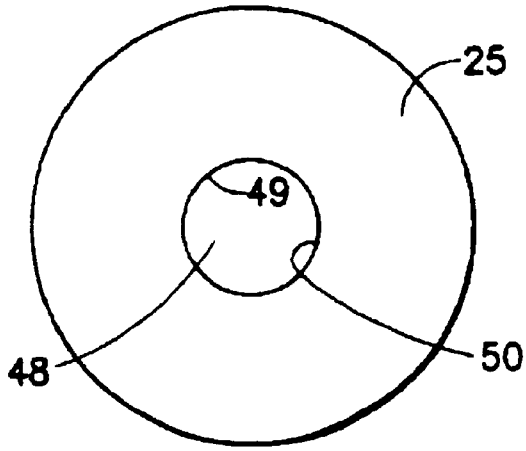
FIG. 11 is a plan view of the valve sealing gasket of the present invention.

The valve stem, valve body and valve housing are molded of plastic, for example nylon. The gasket 25 may be formed of rubber or neoprene of various formulations, and is shown in FIG. 11 in plan view with central opening 48.

In a sample embodiment of the present invention, the following nominal dimensions have been used in an eight-spline configuration to provide a powder valve that provides fully adequate sealing, as well as negligible powder build-up to interfere with the sealing and orifice flow after many successive valve cycles.

Valve stem (22) outer diameter—0.158 inches

Valve stem (22) inner diameter—0.078 inches

Valve body (21) outer diameter—0.163 inches

Stem orifice (23) diameter—0.024 inches

Radial dimension spline top surface (41)—0.0235 inches

Width dimension spline top surface (41)—0.010 inches

Area of spline top surface (41)—0.000235 sq. inches

Vertical angle of spline tapered side (42)—10 degrees

Axial length of spline tapered side (42)—0.042 inches

Axial length of spline vertical side (43)—0.100 inches

Circumferential spline (40) dimension between spline vertical sides (43)—0.025 inches Axial distance stem orifice (23) center to spline top surface (41)—0.038 inches Radial depth of groove (55)—0.0165 inches Axial length groove intermediate surface 57—0.030 inches Axial dimension of groove surface 58—0.022 inches Axial dimension of groove surface 56—0.028 inches Convex radius on groove surface 58—0.091 inches Angle to horizontal of groove surface 58—50 degrees Gasket axial length—0.045 inches Gasket central opening diameter—0.100 inches It will be appreciated by persons skilled in the art that variations and/or modifications may be made to the present invention without departing from the spirit and scope of the invention. The present embodiment is, therefore, to be considered as illustrative and not restrictive. It should also be understood that such terms as "upper", "lower", "intermediate", "inner", "outer", "horizontal", "vertical", "exterior", "interior", "side", "central", "upstanding", "encircling", "surrounding", "outwardly", "inwardly" "downwardly", "upwardly", "above", "below", "overlying", "top", "bottom", and corresponding similar positional terms as used in the specification, are used and intended in relation to the positioning shown in the drawings, and are not otherwise intended to be restrictive.

What is claimed is:

1. An aerosol valve to dispense product containing powder and/or other solids from an aerosol container, comprising in combination: a valve housing; a valve body, a valve stem, and a gasket-retaining groove encircling the valve stem; said valve stem having a discharge passage and at least one valve orifice extending through the stem wall in communication with both the groove and the discharge passage; said valve body and stem being moveable axially with respect to the valve housing between closed and open positions; an annual sealing gasket with a central opening retained within said groove and sealing the one or more valve orifices in said groove when the aerosol valve is closed; the valve body below the stem groove having a plurality of vertical splines spaced about the periphery of the valve body, the plurality of splines having top surfaces abutting and being biased against the underside of the gasket when the valve is in the closed position; a plurality of circumferential spaces extending between said splines and downwardly from the tops of said splines a substantial distance; the top surfaces of the splines having minimal areas in relation to the areas of the circumferential spaces between the tops of the splines, the minimal areas of the spline top surfaces being insufficient to allow build up thereon of product solids to interfere with gasket sealing of the at least one stem valve orifice when the valve is closed; said valve encircling groove, with the at least one valve orifice, having an upper annular surface, an intermediate annular neck portion extending downwardly from said upper surface, and a lower annular surface extending downward and outwardly at a sharp angle to the horizontal from said neck portion to the outer circumference of the valve body, said gasket sealing the lower annular groove surface when the aerosol valve is closed; said lower annular groove surface joining the outer circumference of the valve body at the level of the tops of the splines; and, said aerosol valve being characterized by the groove lower annular surface lacking any gasket sealing horizontal and concave surface components, and the valve body adjacent the groove lacking any gasket sealing horizontal components.

2. The aerosol valve of claim 1, wherein the lower annular surface of the groove is slightly convex.

3. The aerosol valve of claim 1, wherein the gasket wipes downwardly and outwardly across the groove lower annular surface when the aerosol valve moves from open to closed position.

4. The aerosol valve of claim 1, wherein the one or more valve orifices are positioned in the neck portion of the groove.

5. The aerosol valve of claim 1, wherein the diameter of the valve body between the splines, at the level of the tops of the splines, is substantially the same as the diameter of the valve stem above the groove.

* * * * *